US005180158A

United States Patent [19]

Coombs

[11] Patent Number: 5,180,158

[45] Date of Patent: Jan. 19, 1993

[54] MOVING BIN-SET SORTER

[75] Inventor: Peter M. Coombs, Tustin, Calif.

[73] Assignee: Gradco (Japan) Ltd., Tokyo, Japan

[21] Appl. No.: 823,401

[22] Filed: Jan. 21, 1992

[51] Int. Cl.[5] ..... B65H 39/10

[52] U.S. Cl. ..... 271/293; 271/294; 271/224

[58] Field of Search ..... 271/292, 293, 294, 224

[56] References Cited

U.S. PATENT DOCUMENTS

| | | | |
|---|---|---|---|
| 4,621,803 | 11/1986 | Johdai et al. | 271/293 |
| 4,842,264 | 6/1989 | Kosaka et al. | 271/293 |
| 4,872,663 | 10/1989 | Latone | 271/292 |
| 5,050,860 | 9/1991 | Matsuo et al. | 271/293 |
| 5,112,035 | 5/1992 | Yamamoto et al. | 271/293 |

FOREIGN PATENT DOCUMENTS

| | | | |
|---|---|---|---|
| 13571 | 1/1990 | Japan | 271/292 |

*Primary Examiner*—Robert P. Olszewski
*Assistant Examiner*—Steven M. Reiss
*Attorney, Agent, or Firm*—Newton H. Lee, Jr.

[57] ABSTRACT

A moving tray sorter has a set of trays forming sheet receiving bins to which successive sheets are to be supplied from a typical office copier or printer. The trays are mounted in a support at ends remote from the host machine to pivot on horizontal axes and move longitudinally as the ends of the trays into which sheets are supplied are moved vertically past a sheet entry location by a tray shifter which moves the trays sequentially and as a set between locations below a sheet receiving position, upwardly to the sheet receiving position. The ends of the trays adjacent to the host machine are separably supported one on the other and are shifted in unison upon upward and downward movement of the lowermost tray.

4 Claims, 6 Drawing Sheets

MOVING BIN-SET SORTER

BACKGROUND OF THE INVENTION

Machines of the shifting tray type have heretofore been provided to receive sheets of paper from a copier or printer. Such machines have involved various means for shifting the sheet inlet ends of the trays vertically past a sheet entry position so that the sheets may be fed into the receiving trays without complex sheet transport systems involving travelling belts or rollers and some form of deflector to direct sheets from the transport into the trays for collating sheets supplied from a copier or receiving collated sets of sheets from a printer, as well as for simply receiving one or more sheets in a selected tray for mailboxing or pigeon-holing the output from a copier, printer or facsimile machine.

Such machines are represented by Lawrence U.S. Pat. No. 4,343,463 and DuBois and Hamma U.S. Pat. No. 4,328,963 wherein the sheet receiving ends of the trays are successively moved by cams from closely spaced positions above and below the sheet entry location to widely spaced or separated positions at the sheet entry location. Also, sets of horizontally extended trays have been supported in a frame or cage which is vertically shifted to the sheet entry location, as shown, for example, in Shirahase U.S. Pat. No. 4,162,787.

Fazio et al U.S. Pat. No. 4,830,358 discloses a set of fixed trays into which sheets are fed by a pivotal infeed.

In addition, as seen in Lawrence U.S. Pat. No. 4,843,434, a bin opener may be employed to move vertically relative to a set of trays and open the trays to receive sheets, while the trays remain close together at other times.

Langner U.S. Pat. Nos. 4,265,445 and 4,228,070 disclose a set of fixed trays to which a sheet guide or infeed is progressively moved, and DuBois U.S. Pat. No. 4,478,406 shows such a sorter in which the trays are sequentially spread apart to enhance sheet entry.

SUMMARY OF THE INVENTION

The present invention provides a simple and inexpensive, small sheet receiving machine for use with small copiers, printers or facsimile machines in a structure which lends itself to use with small host machines, wherein the bin set is moved in a unique manner while affording access to the sets.

More particularly, the invention provides a sheet receiving machine having a number of horizontally extended trays forming a set of bins which are shifted as a set at least at their ends adjacent to a host copier, printer or facsimile machine so as to successively be positioned to receive sheets exiting from the host machine, with the successive sheet entry ends of each tray in the same position when receiving a sheet from the host machine. The trays are adapted to be manually spread apart to facilitate set removal, by virtue of the ends of the tray at one end thereof being freely mounted one on the other on bearings which are separable and being pivotally mounted at their other ends to allow the trays to be spread apart.

In accomplishing the foregoing, there is provided a base support on which the ends of the trays remote from the sheet entry location are pivotally carried in a vertically extended support which is horizontally slidable on the host support as the trays are actuated at their ends adjacent to the sheet exit location from the host machine and vertically moved in succession between positions above and below the sheet receiving position adjacent to the sheet exit from the host machine.

The invention has other features and advantages which will become apparent from the drawings forming a part hereof when viewed in the light of the following description and claims.

DETAILED DESCRIPTION

Figure 1:
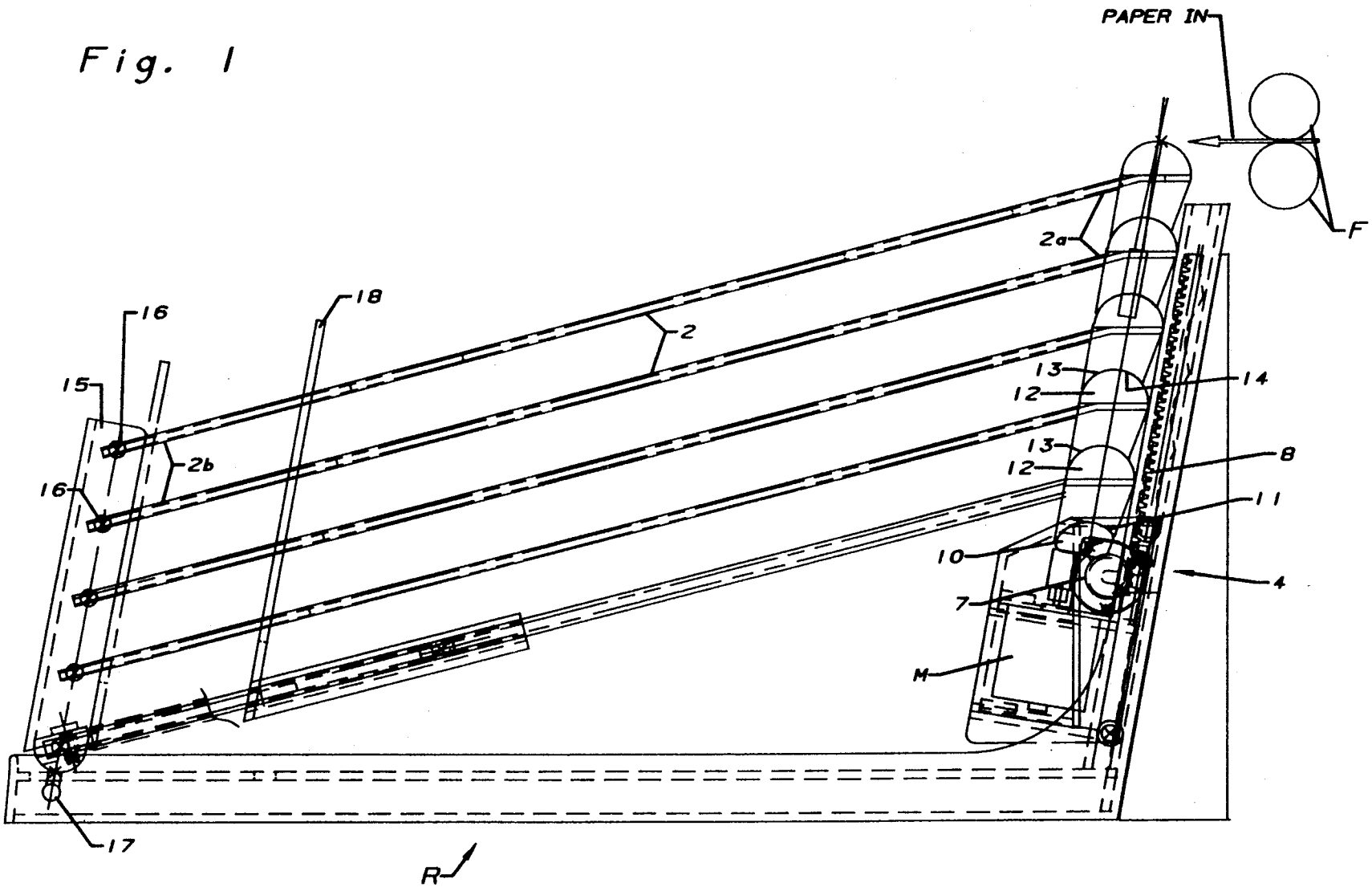
FIG. 1 is a side elevation showing the sheet receiver with the trays located in their lower, stacked positions below the sheet entry position for receiving sheets in the top tray.
Figure 3:
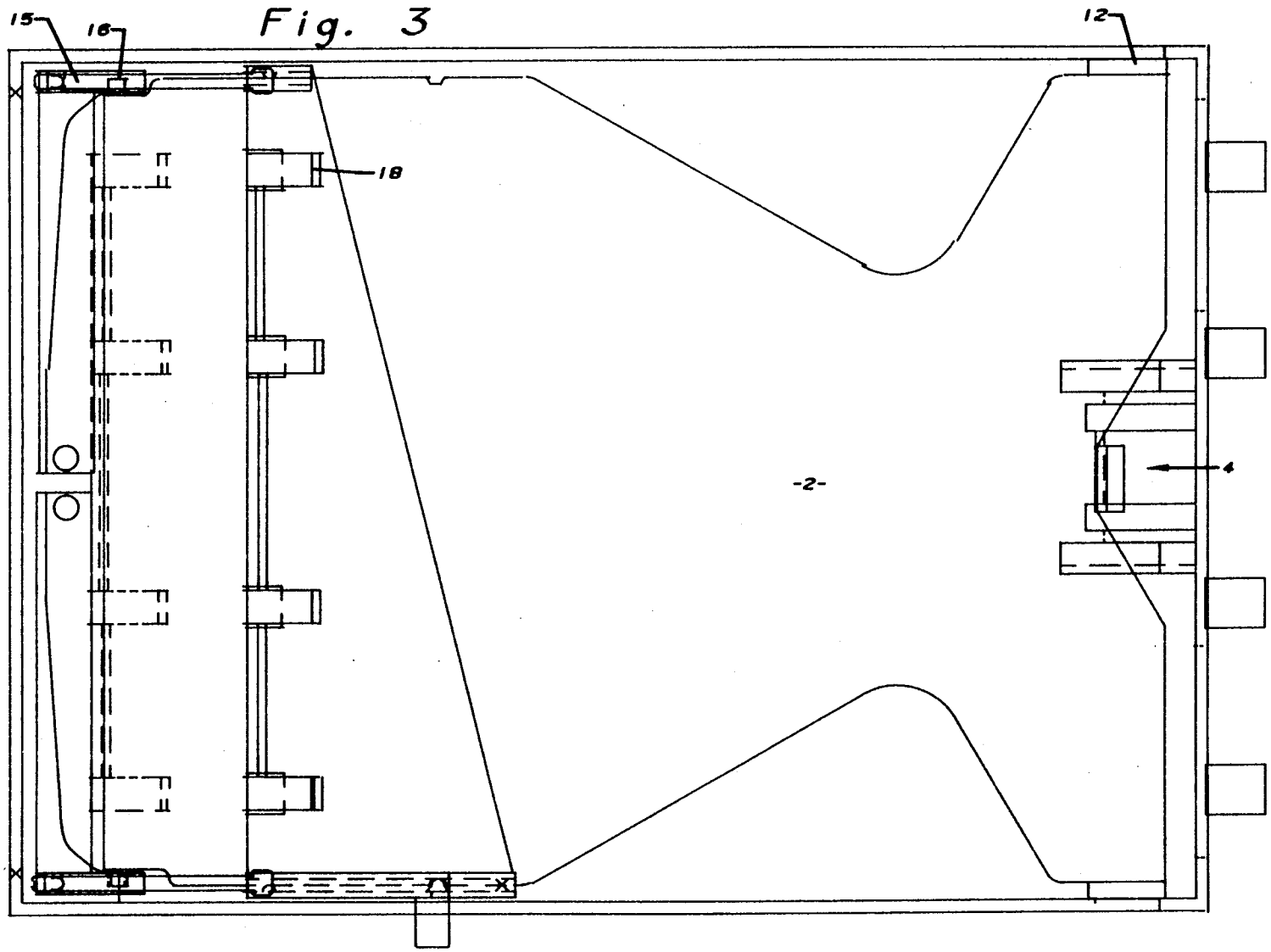
FIG. 3 is a top plan view of the sorter as seen in FIG. 1.

As seen in the drawings the sheet receiving machine or sorter R of the invention has a main frame 1 adapted to be positioned adjacent to a host machine constituting a source of sheets, such as a copier, printer or facsimile machine to receive in trays 2 sheets of paper supplied by feed rolls F from the host machine when the trays are located at the position indicated by the arrow designated "Paper In", which is the sheet entry location for the receiver. It will be seen that all of the trays are below the sheet entry location in FIG. 1 and all but the lowermost tray are above the sheet entry location in FIG. 2, so that when the machine R is not being used to collate, the upper tray in FIG. 1 functions as a receiver tray into which are deposited all sheets exiting the host machine.

The ends of tray 2 designated **2*a* are sheet inlet ends located adjacent the host machine, while the ends 2*b* of the trays are remote from the host machine. The sheet inlet ends 2*a* are individually, separably supported one on the other while the remote ends 2*b* are supported to allow the sheet inlet ends to swing upwardly or downwardly so that the trays, at ends 2*a***, may be shifted upwardly and downwardly relative to the sheet receiving location at the Paper In level.

Figure 2:
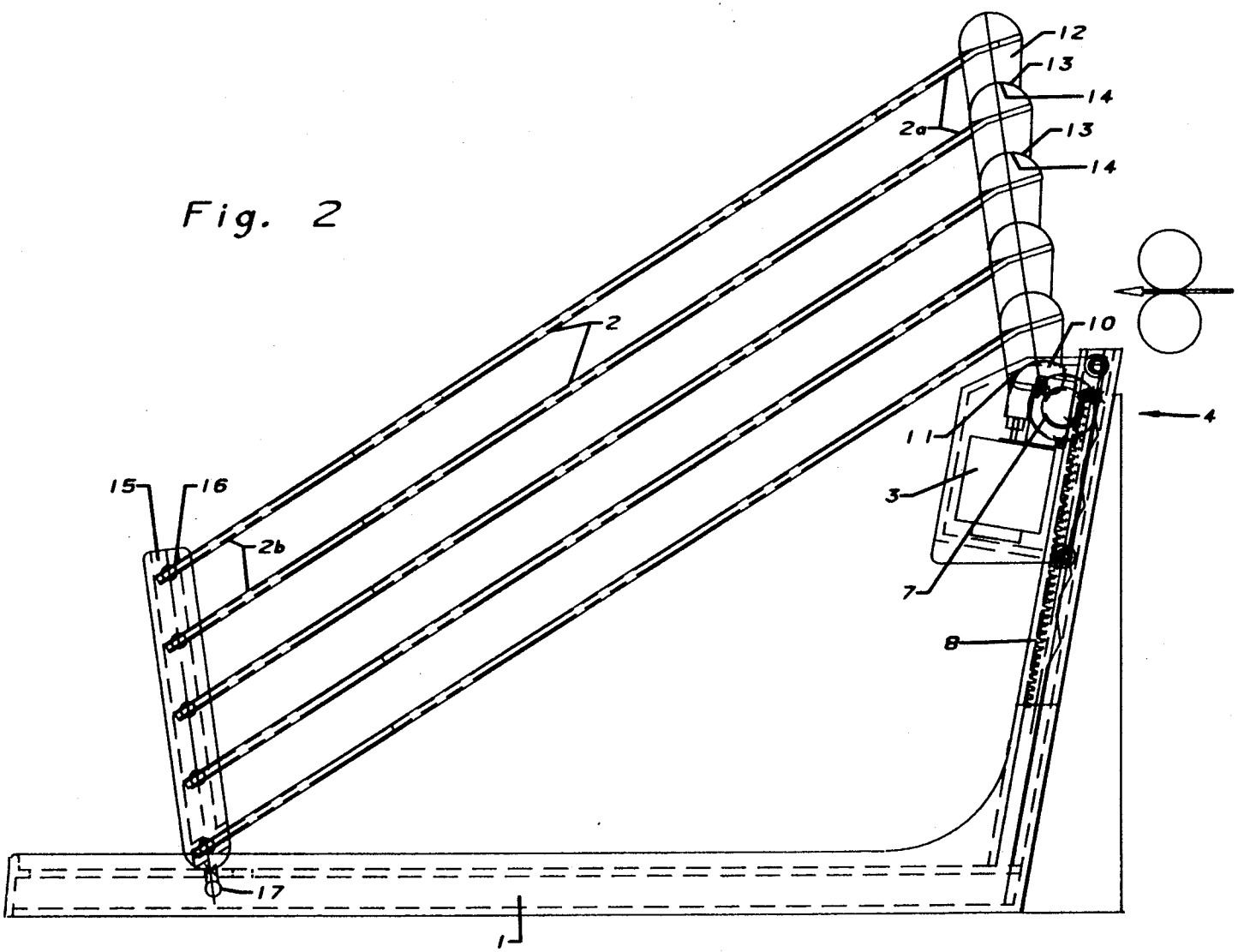
FIG. 2 is a view corresponding with FIG. 1, but showing the trays in their upper position for receiving sheets in the lowermost tray.
Figure 4:
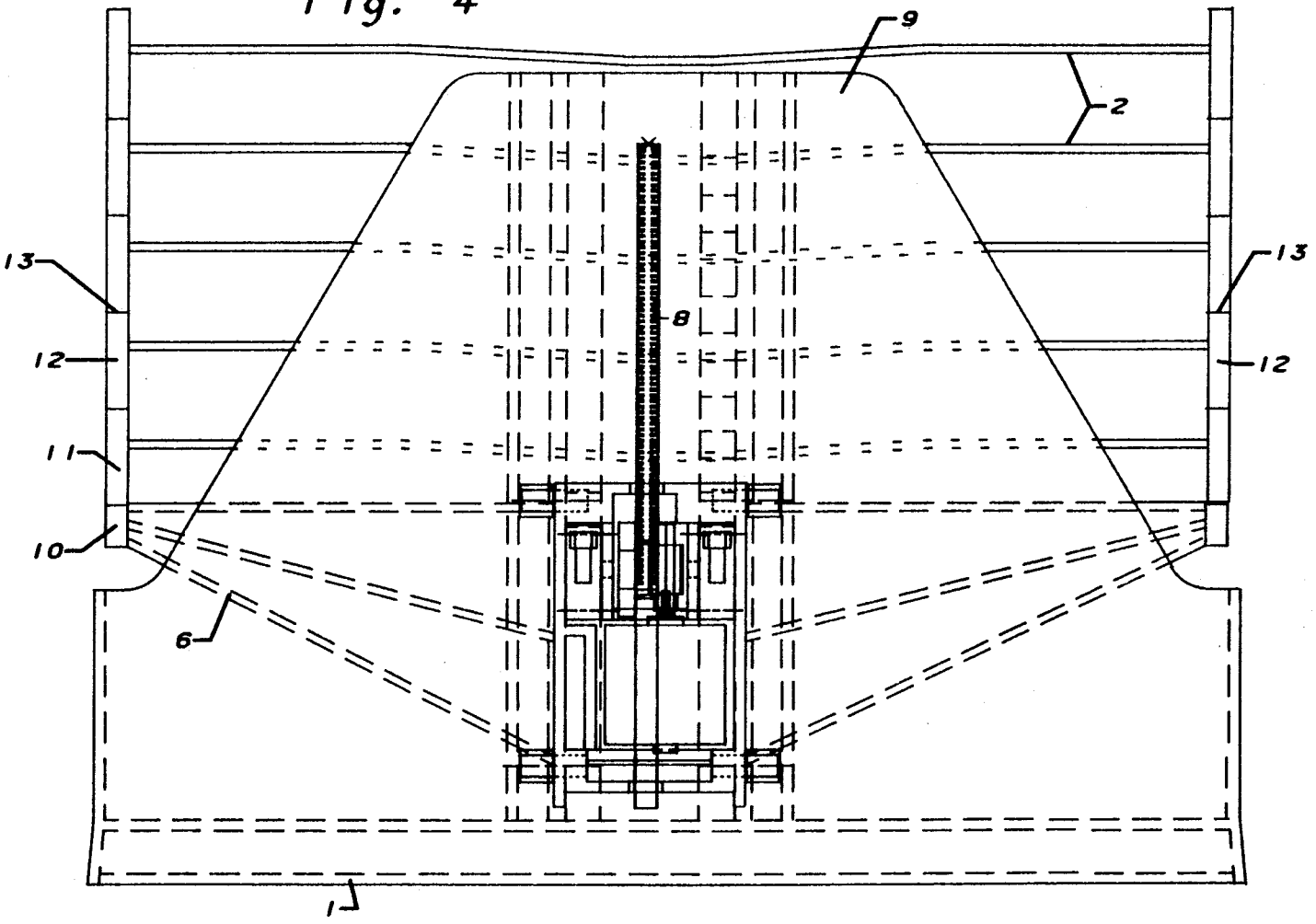
FIG. 4 is a right side elevation of the sorter as shown in FIG. 1.
Figure 5:
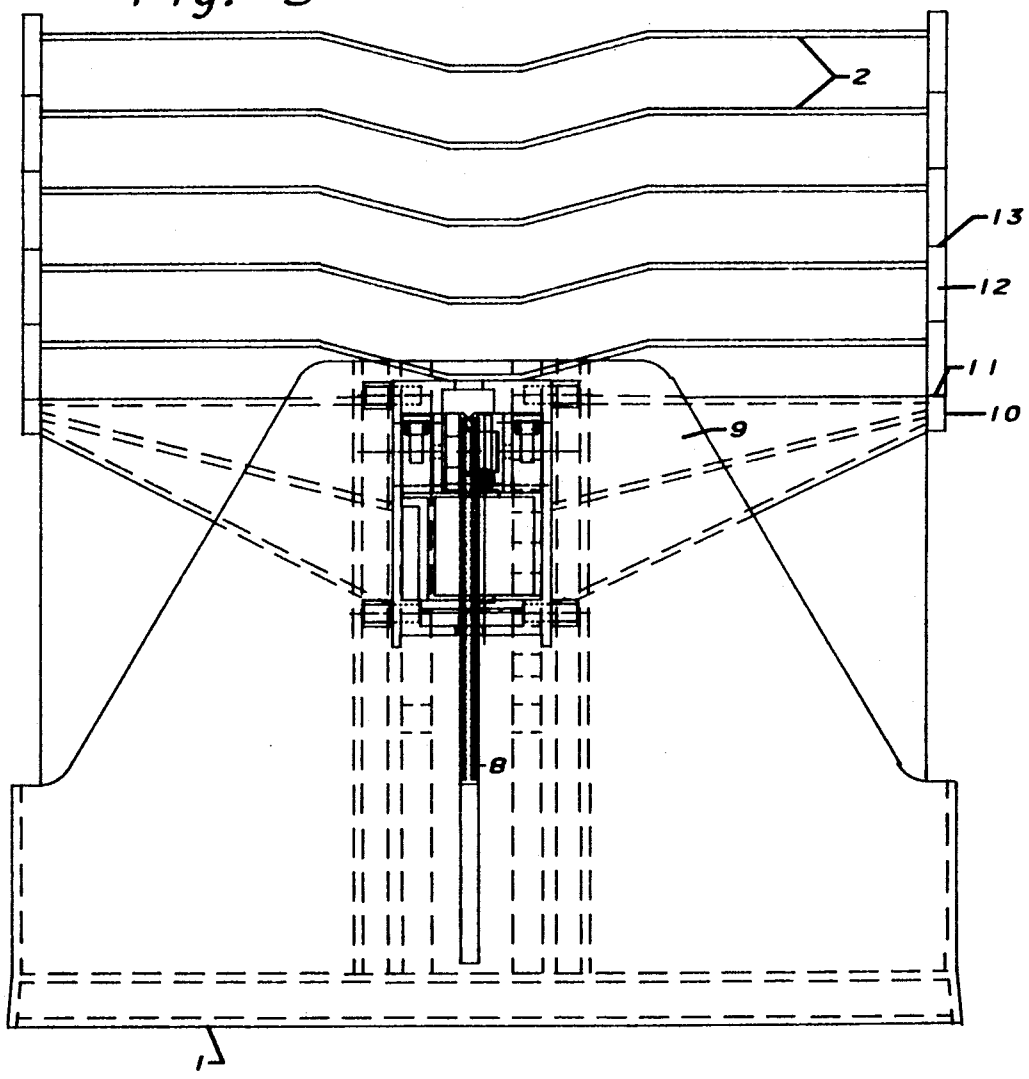
FIG. 5 is a side elevation of the sorter as shown in FIG. 2.
Figure 6:
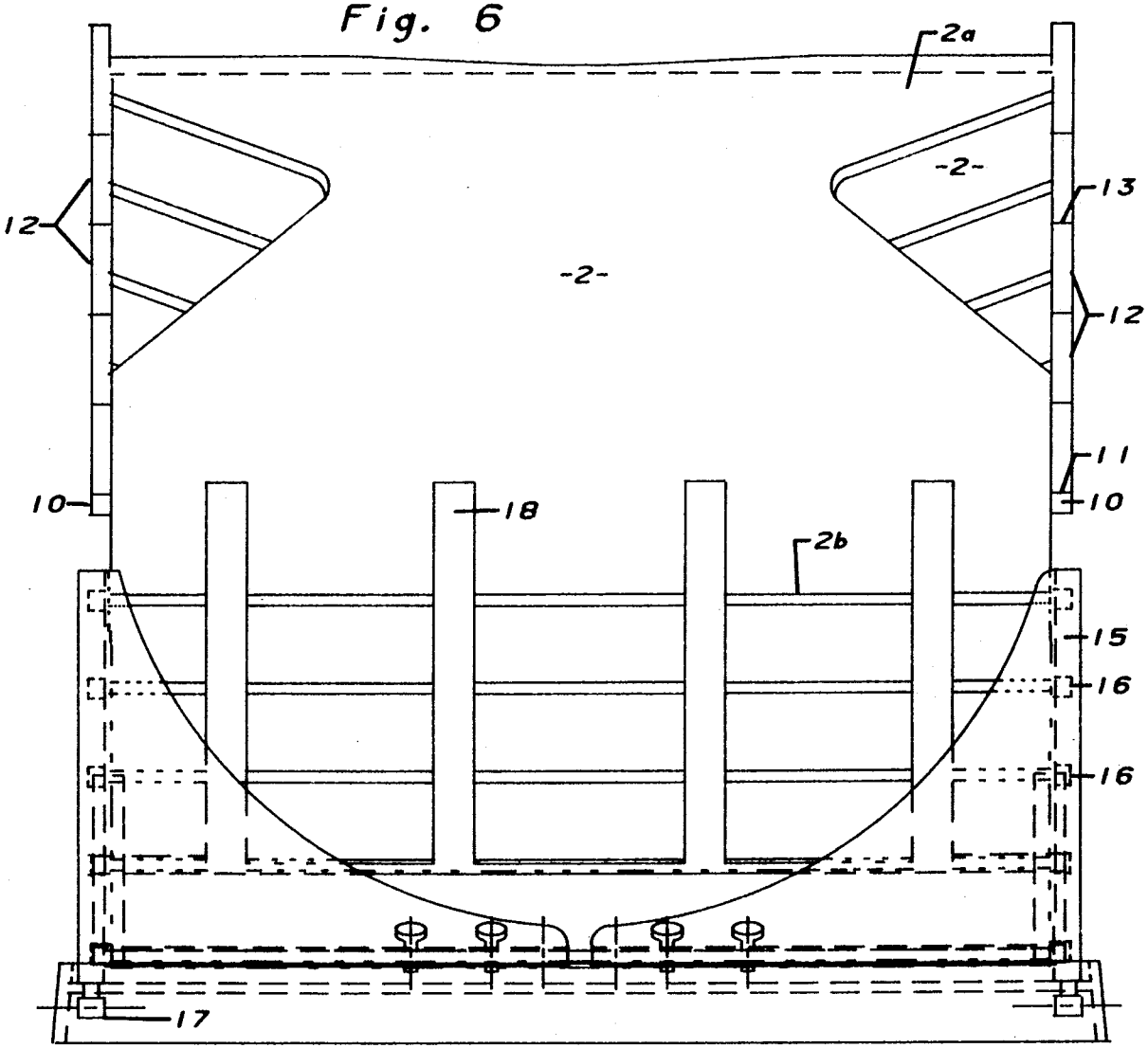
FIG. 6 is a left side elevation of the sorter as shown in FIG. 2.

To cause the tray ends **2*a* to be moved between the positions of FIG. 1 and FIG. 2, bi-directional actuator means 4 are provided, including an electric motor M suitably supported centrally of a cross member 6 vertically shiftable relative to the base and driving a pinion 7 which is in mesh with a rack 8 fixed in a frame section 9 between the lower position of FIG. 1 and the upper position of FIG. 2. Motor M is adapted to be controlled in ways well known in the art to shift the cross member 6 incrementally as the sheet or a desired member of sheets has been fed into a tray, so that tray ends 2*a* are shifted sequentially but as a set upwardly and downwardly to the sheet receiving position and held in that position until the next tray is to be moved into the sheet receiving position. It will be recognized, without illustration, that the relationship of the motor and rack may be reversed so that the motor is stationary and the rack is shiftably supported depending upon which of the motor or rack is mounted on the cross support 6 and the frame portion 9**.

To separably support the tray ends 2*a* one on the other, the motor support 6 has at its upper end, a cross support member 10 having a partially arched or cylindrical upper surface 11. Each tray end 2*a*, has a support member 12 at each of its opposite sides having an arched or cylindrical upper surface 13 and an arched or cylindrical lower surface 14. The support members 12 rest one on the other, with the lowest support 12 resting on the motor support member 10. Thus, the tray ends can move together with the motor and cross support 10, but the tray ends 2*a* can be lifted or separated one from the other to facilitate removal of sheets or sets of sheets from the bins defined by the trays.

The support for the ends 2*b* of the trays enables the movement of the trays at their ends 2*a*. An upwardly extended support 15 at the tray ends 2*b* is pivotally connected by pins 16 to the tray ends enabling the ends 2*a* to swing open as described above. In addition, to enable swinging movement of the set of tray ends 2*a* between the position of FIG. 1 and the position of FIG. 2, the support 15 is mounted for longitudinal sliding movement and pivotal movement at its lower end by means of a guide pin 17 at each of its opposite sides engaged beneath a rail 18 in the frame structure. As support 15 slides longitudinally on the remote end of the base frame 1, the angle of inclination of the trays 2 progressively changes, causing support 15 to move at its lower end and change angle to allow the horizontal displacement of tray ends 2*a*.

To accommodate sheets of paper of different lengths in the trays and provide an alignment surface against which the sheets can abut as they are fed into the trays, the trays may be provided with an upwardly extended back stop 18 slidably supported on the bottom tray and positioned at different locations lengthwise of the trays as seen in the full and broken line positions of FIG. 1. The backstop is shown only in FIG. 1 for clarity.

It will be noted that since the tray ends 2*a* are separably supported one on the other above the lowermost tray, if desired, means (not shown) may be employed at the sheet entry location to elevate all trays above the sheet entry location to afford increased sheet entry space.

I claim:

1. A moving tray sheet receiver for receiving successive sheets of paper from the sheet outlet of a host copier, printer or facsimile machine comprising: a base support, a plurality of elongated and vertically spaced sheet receiving trays extending horizontally above said base support, said trays having first ends remote from the sheet outlet of the host machine supported on said base support for pivotal and longitudinal movement, and operating means at the sheet inlet ends of said trays adjacent to the host machine operable to sequentially raise and lower the sheet inlet ends of said trays sequentially and as a set between a lower position at which the uppermost tray is below a sheet entry location and an upper position at which the sheet inlet ends of the trays except the lowermost tray are above the sheet entry location for receiving sheets supplied from the sheet outlet of the host machine, and means freely and separably supporting the sheet inlet ends of said trays one on the other for vertical separation to enable sheet removal.

2. A moving tray sheet receiver as defined in claim 1, wherein the first ends of said trays are pivotally mounted on a support member extending upwardly from said base support, said support member and said base support having means longitudinally slidably mounting said support member at its lower end for pivotal movement on a horizontal axis, and said trays extending to their sheet inlet ends on an incline towards the sheet outlet of the host machine.

3. A moving tray sheet receiver as defined in claim 1, wherein said operating means comprises an electric motor and pinion engaged with a rack, one of said motor and said rack being fixed on said base support and the other of said motor and said rack being vertically shiftably mounted on said base support and engaged with the lowermost tray to raise and lower all of the trays.

4. A moving tray sheet receiver as defined in claim 3, wherein said trays are inclined from their first ends towards said theet inlet ends, and the lowermost tray is supported on said motor or said rack and each superjacent tray is separably mounted on the tray below it on surfaces enabling relative longitudinal and angular displacement of the trays during upward and downward movement.

* * * * *